US008519289B2

(12) United States Patent
Schaltenbrand et al.

(10) Patent No.: US 8,519,289 B2
(45) Date of Patent: Aug. 27, 2013

(54) ELECTRICAL SWITCHING APPARATUS AND SECONDARY TRIP MECHANISM THEREFOR

(75) Inventors: Brian John Schaltenbrand, Pittsburgh, PA (US); Andrew Lawrence Gottschalk, Monaca, PA (US); Brandy Lamar Tanner, Bessemer City, NC (US)

(73) Assignee: Eaton Corporation, Cleveland, OH (US)

( * ) Notice: Subject to any disclaimer, the term of this patent is extended or adjusted under 35 U.S.C. 154(b) by 209 days.

(21) Appl. No.: 13/185,031

(22) Filed: Jul. 18, 2011

(65) Prior Publication Data

US 2013/0020184 A1 Jan. 24, 2013

(51) Int. Cl.
*H01H 23/00* (2006.01)

(52) U.S. Cl.
USPC ..... 200/401

(58) Field of Classification Search
USPC ..... 200/401, 336, 337, 318, 325, 411, 200/415, 424, 430, 43.16, 50.01, 50.28, 43.01, 200/43.02
See application file for complete search history.

(56) References Cited

U.S. PATENT DOCUMENTS 5,424,701 A * 6/1995 Castonguay et al. ..... 335/172
6,437,269 B1 8/2002 Rakus
7,518,076 B1 4/2009 Gottschalk et al.
7,633,031 B2 * 12/2009 Wehrli et al. ..... 200/401
7,687,733 B2 * 3/2010 Weister et al. ..... 200/400
2008/0271982 A1 11/2008 Gibson et al.
2008/0302640 A1 12/2008 Weister et al.
2010/0032269 A1 2/2010 Schaltenbrand et al.
2011/0062005 A1 3/2011 Gottschalk et al.
2011/0062006 A1 3/2011 Gottschalk et al.
2011/0073451 A1 3/2011 Gottschalk et al.

OTHER PUBLICATIONS

European Patent Office, "extended European search report", Oct. 25, 2012, 6 pp.

* cited by examiner

*Primary Examiner* — R S Luebke
*Assistant Examiner* — Harshad Patel
(74) *Attorney, Agent, or Firm* — Eckert Seamans Cherin & Mellott, LLC; Grant E. Coffield

(57) ABSTRACT

A secondary trip mechanism is provided for an electrical switching apparatus, such as a circuit breaker. The circuit breaker includes a housing, separable contacts enclosed by the housing, and an operating mechanism for opening and closing the separable contacts. The operating mechanism includes a poleshaft, a latch assembly, and a trip D-shaft for unlatching the latch assembly in response to a trip condition. The secondary trip mechanism includes a trip D-shaft assembly disposed on the trip D-shaft, and a link assembly. The link assembly includes a linking member having opposing first and second ends. The first end cooperates with the poleshaft. The second end cooperates with the trip D-shaft assembly. When the poleshaft moves in response to a trip condition, the linking member transmits movement of the poleshaft into movement of the trip D-shaft assembly. An electrical switching apparatus is also disclosed.

16 Claims, 5 Drawing Sheets

9

ELECTRICAL SWITCHING APPARATUS AND SECONDARY TRIP MECHANISM THEREFOR

BACKGROUND

1. Field

The disclosed concept relates generally to electrical switching apparatus and, more particularly, to electrical switching apparatus, such as circuit breakers. The disclosed concept also relates to secondary trip mechanisms.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts that are separable from the stationary electrical contacts.

Among other components, the operating mechanisms of some low and medium voltage circuit breakers, for example, typically include a poleshaft, a trip actuator assembly, a closing assembly and an opening assembly. The trip actuator assembly responds to the trip unit and actuates the operating mechanism. The closing assembly and the opening assembly may have some common elements, which are structured to move the movable electrical contacts between a first, open position, wherein the movable and stationary electrical contacts are separated, and a second, closed position, wherein the movable and stationary electrical contacts are electrically connected. Specifically, the movable electrical contacts are coupled to the poleshaft. Elements of both the closing assembly and the opening assembly, which are also pivotably coupled to the poleshaft, pivot the poleshaft in order to effectuate the closing and opening of the electrical contacts.

It is important to that sufficient tripping force is provided to ensure the circuit breaker does, in fact, trip in response to a trip condition.

There is, therefore, room for improvement in electrical switching apparatus, such as circuit breakers, and in secondary trip mechanisms therefor.

SUMMARY

These needs and others are met by embodiments of the disclosed concept, which are directed to a secondary trip mechanism for an electrical switching apparatus, such as a circuit breaker. Among other benefits, the secondary trip mechanism cooperates with the poleshaft to ensure the electrical switching apparatus properly trips in response to a trip condition.

As one aspect of the disclosed concept, a secondary trip mechanism is provided for an electrical switching apparatus. The electrical switching apparatus includes a housing, separable contacts enclosed by the housing, and an operating mechanism for opening and closing the separable contacts. The operating mechanism comprises a poleshaft, a latch assembly, and a trip D-shaft structured to unlatch the latch assembly in response to a trip condition. The secondary trip mechanism comprises: a trip D-shaft assembly structured to be disposed on the trip D-shaft; and a link assembly comprising a linking member, the linking member including a first end and second end disposed opposite and distal from the first end, the first end being structured to cooperate with the poleshaft, the second end cooperating with the trip D-shaft assembly. When the poleshaft moves in response to a trip condition, the linking member is structured to transmit movement of the poleshaft into movement of the trip D-shaft assembly.

The trip D-shaft assembly may include a hub having a recess, wherein the second end of the linking member cooperates with the shaft hub at or about the recess. The poleshaft may include an interlock pin, and the first end of the linking member may include a barb. The barb may be structured to interlock with the interlock pin. When the barb interlocks with the interlock pin, the linking member may be structured to move with the poleshaft.

The link assembly may further comprise a biasing element including a first end and a second end disposed opposite and distal from the first end of the biasing element. The first end of the biasing element may structured to be coupled to the housing of the electrical switching apparatus and the second end of the biasing element may be coupled to the linking member to bias the linking member into engagement with the poleshaft.

The housing of the electrical switching apparatus may further include a side plate assembly comprising a side plate. The side plate assembly may further comprise a cam action pin, wherein the cam action pin extends laterally outwardly from the side plate toward the linking member. The linking member may further comprise a cam surface, wherein the cam action pin is structured to cooperate with the cam surface to move the second end of the linking member into and out of engagement with the D-shaft.

An electrical switching apparatus including the aforementioned secondary trip mechanism is also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
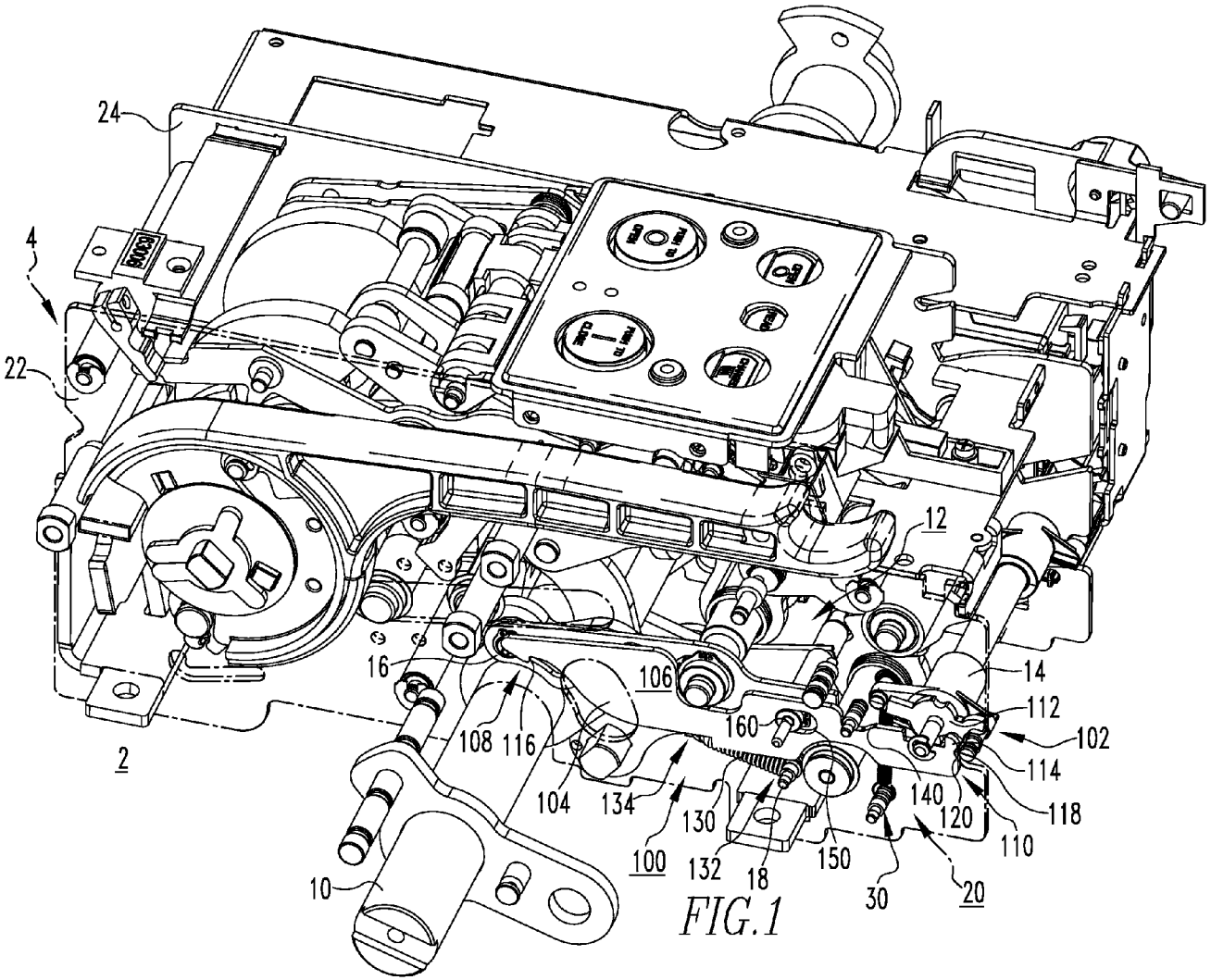
FIG. 1 is an isometric view of a portion of a circuit breaker and a secondary trip mechanism therefor, in accordance with an embodiment of the disclosed concept, with a portion of the circuit breaker shown in phantom line drawing to show hidden structures.

Directional phrases used herein, such as, for example, clockwise, counterclockwise, left, right, upward, downward and derivatives thereof, relate to the orientation of the elements shown in the drawings and are not limiting upon the claims unless expressly recited therein.

As employed herein, the phrase "toe touch position" refers to a position of an electrical switching apparatus (e.g., without limitation, circuit breaker) corresponding to an arcing contact portion (commonly referred to in the art as a "toe") of a movable contact of the circuit breaker engaging a corresponding portion of a stationary contact of the circuit breaker.

As employed herein, the term "trip condition" refers to any abnormal electrical condition which could cause a circuit breaker or other electrical switching apparatus to trip expressly including, without limitation, an overcurrent condition, an overload condition, an undervoltage condition, or a relatively high level short circuit or fault condition.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 3:
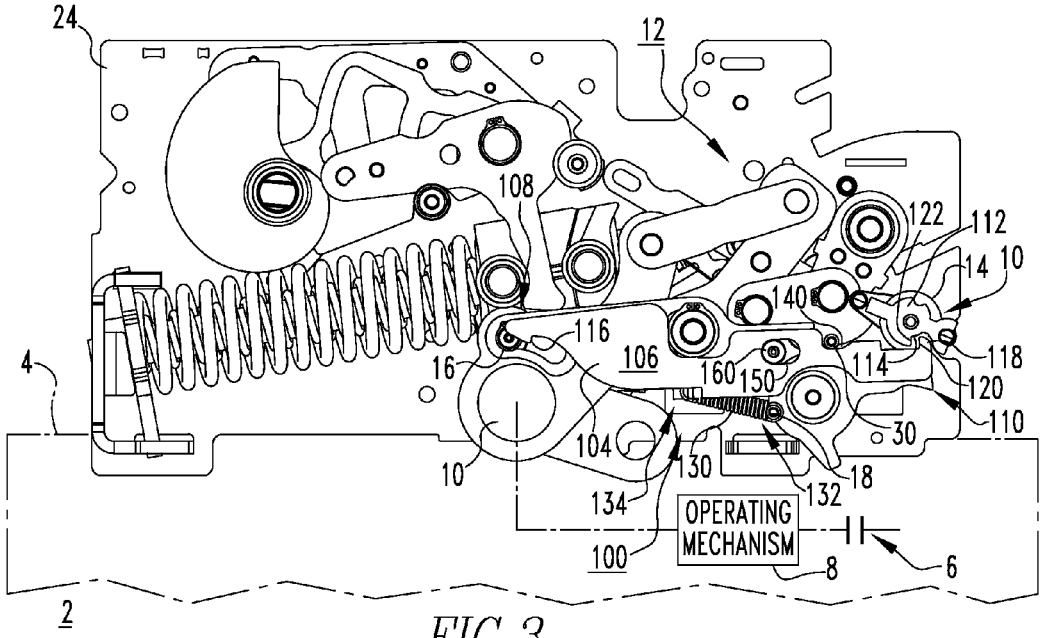
FIG. 3 is a side elevation view of the secondary trip mechanism of FIG. 2, shown in the orientation corresponding to the circuit breaker being open and discharged, also showing a portion of the circuit breaker housing, operating mechanism and separable contacts in simplified form.

FIG. 1 shows a portion of an electrical switching apparatus, such as a circuit breaker 2, employing a secondary trip mechanism 100 in accordance with the disclosed concept. The circuit breaker 2 includes a housing 4 (partially shown in phantom line drawing; see also FIG. 3), separable contacts 6 (shown in simplified form in FIG. 3) enclosed by the housing 4, and an operating mechanism 8 (shown in simplified form in FIG. 3) for opening and closing the separable contacts 6 (FIG. 3). The operating mechanism 8 (FIG. 3) includes a poleshaft 10 and a latch assembly 12. A trip D-shaft 14 is structured to unlatch the latch assembly 12 in response to a trip condition, in order to trip open the circuit breaker 2 in a generally well known manner.

Figure 2:
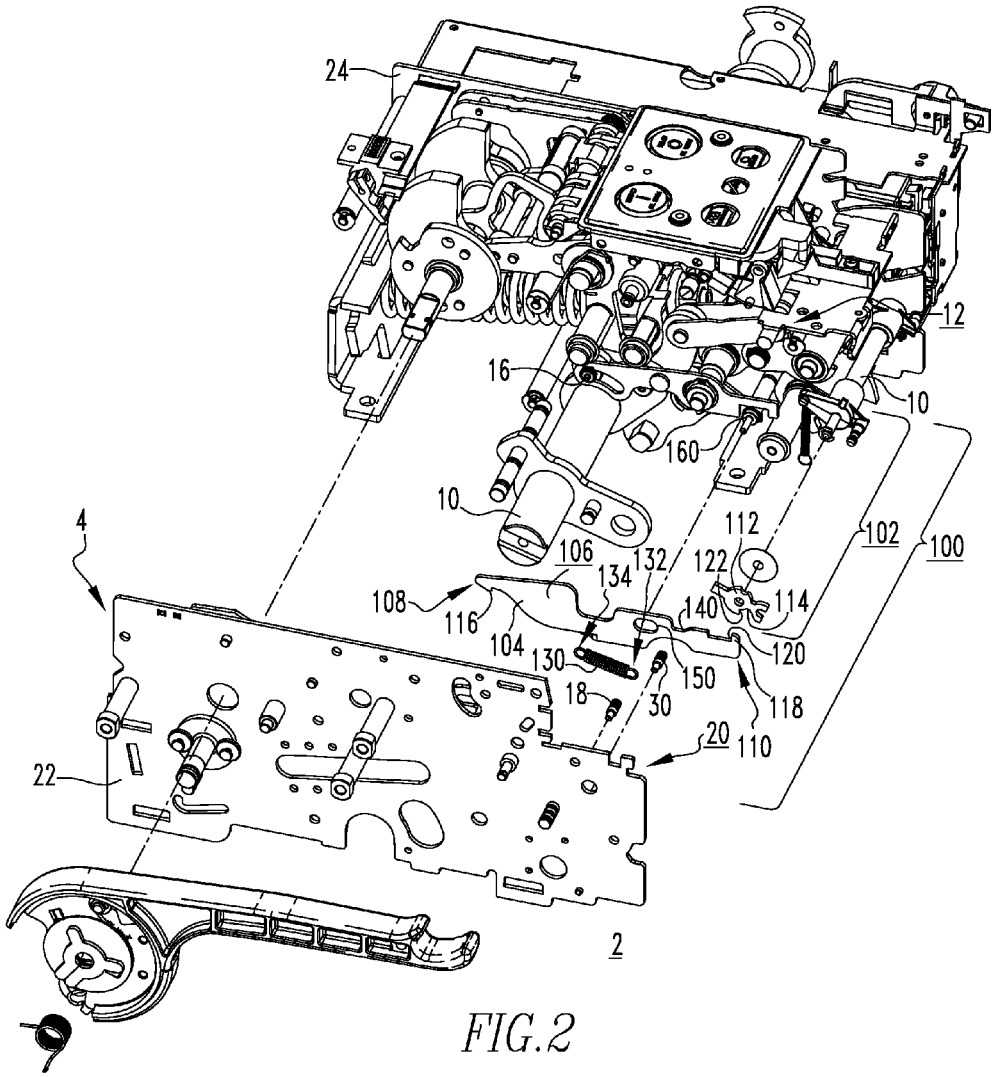
FIG. 2 is an exploded isometric view of the portion of the circuit breaker and secondary trip mechanism therefor of FIG. 1.

Continuing to refer to FIG. 1, and also to the exploded view of FIG. 2, the secondary trip mechanism 100 shown and described herein, includes a trip D-shaft assembly 102 disposed on the trip D-shaft 14, and a link assembly 104. The link assembly 104 includes a linking member 106 having opposing first and second ends 108,110. The first end 108 of the linking member 106 cooperates with the poleshaft 10, as described in greater detail hereinbelow. The second end 110 of the linking member 106 cooperates with the trip D-shaft assembly 102 and, in particular, a hub 112. Specifically, the hub 112 is disposed on the trip D-shaft 14, and includes a recess 114. The second end 110 of the linking member 106 cooperates with the shaft hub 112 at or about the recess 114, as shown in the side elevation views of FIGS. 3-8.

Figure 4:
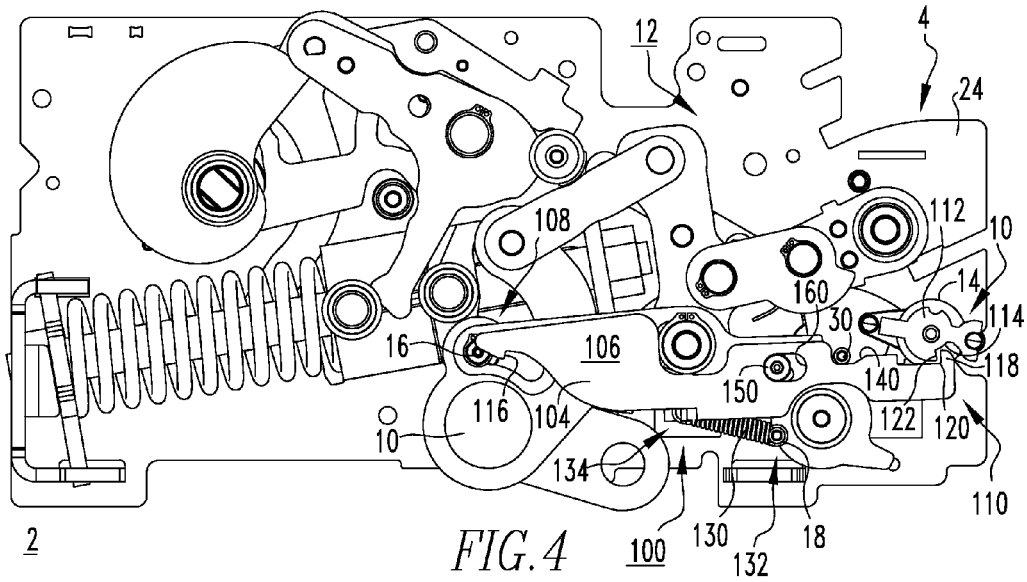
FIG. 4 is a side elevation view of the secondary trip mechanism of FIG. 3, shown in the orientation corresponding to the circuit breaker being charged and open.
Figure 5:
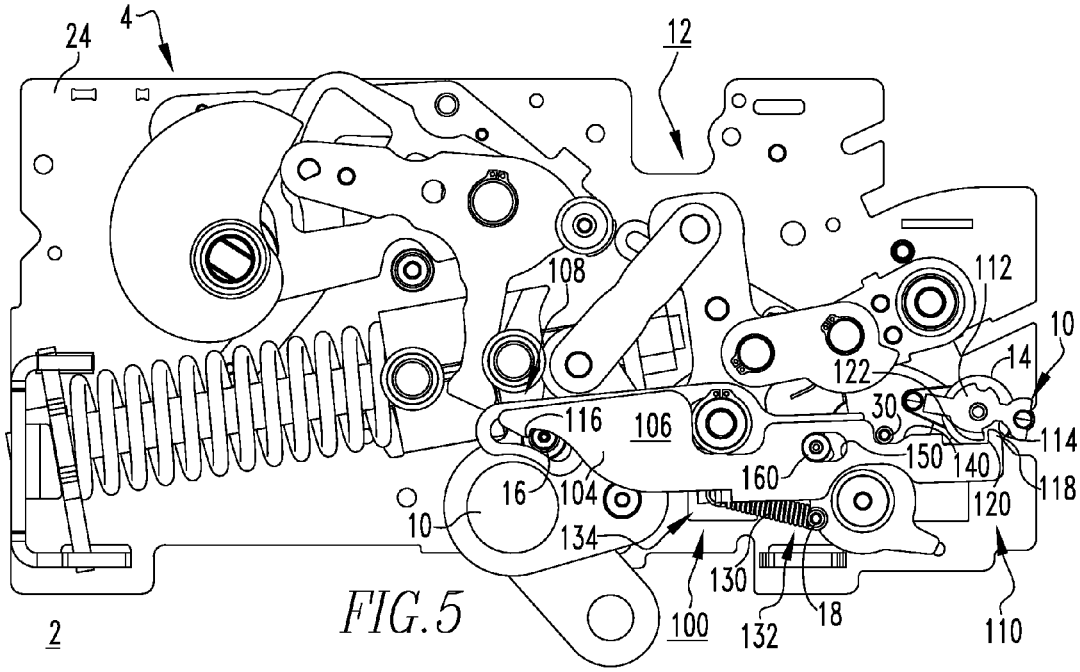
FIG. 5 is a side elevation view of the secondary trip mechanism of FIG. 4, shown in the orientation corresponding to the circuit breaker being disposed in the toe touch position.
Figure 6:
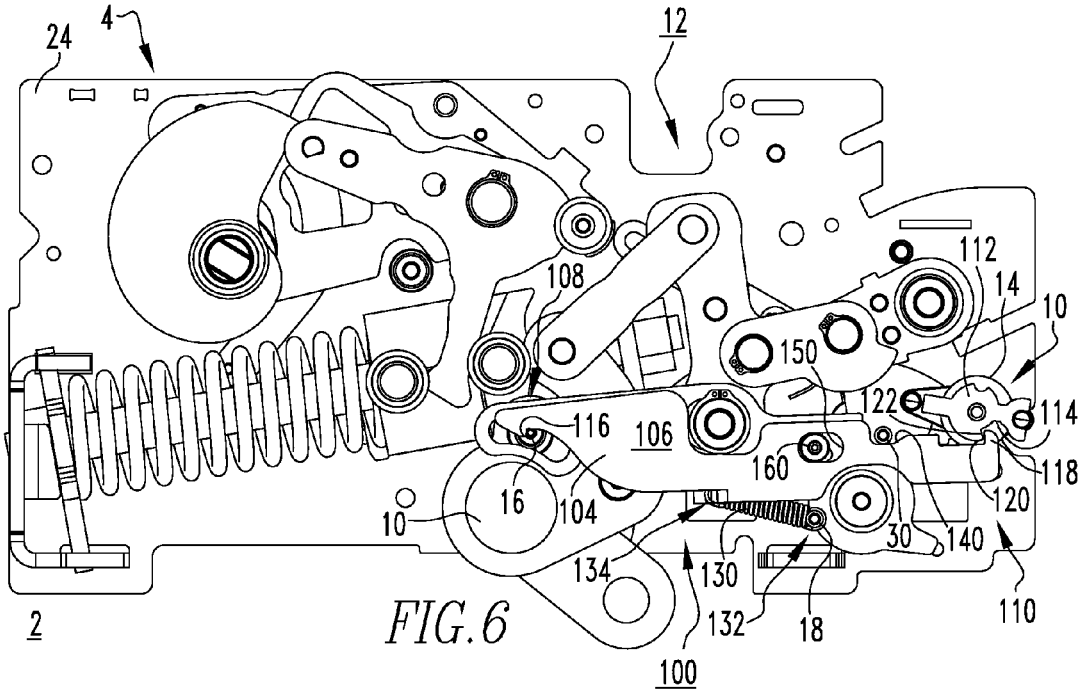
FIG. 6 is a side elevation view of the secondary trip mechanism of FIG. 5, shown in the orientation just prior to the circuit breaker tripping open.
Figure 7:
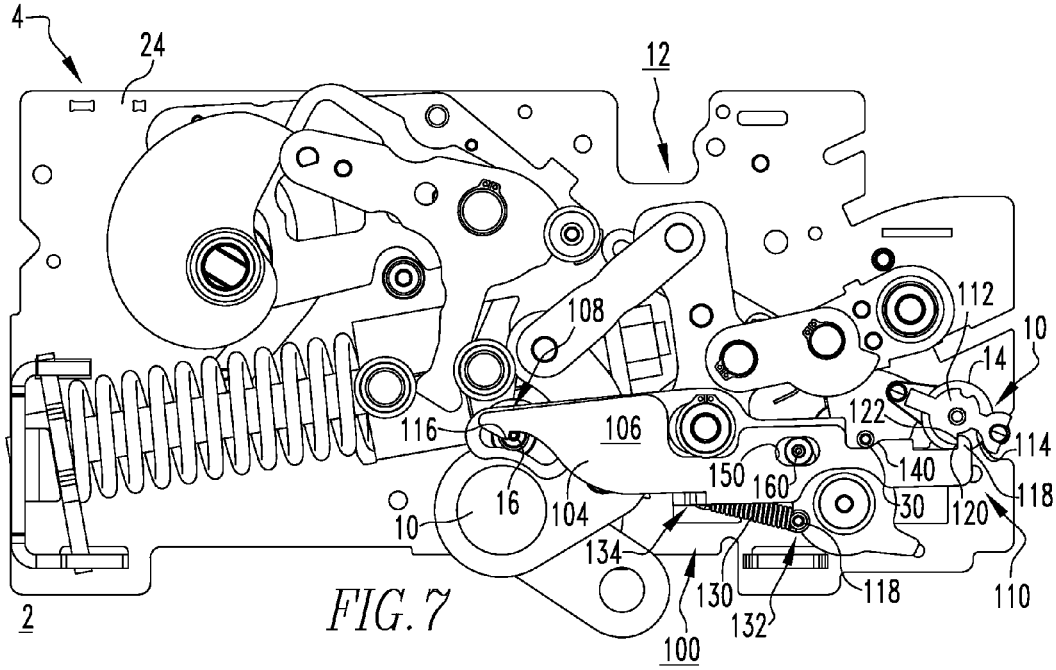
FIG. 7 is a side elevation view of the secondary trip mechanism of FIG. 6, shown in the orientation corresponding to the circuit breaker having tripped open.

As shown in FIGS. 3-8, the poleshaft 10 includes an interlock pin 16. The first end 108 of the linking member 106 preferably includes a barb 116 structured to cooperate (e.g., without limitation, interlock) with the interlock pin 16. More specifically, when the barb 116 interlocks with the interlock pin 16, as shown in FIGS. 6 and 7, the linking member 106 moves with the poleshaft 10. Accordingly, the disclosed secondary trip mechanism 100 provides a mechanical link (e.g., without limitation, linking member 106 of link assembly 104) that interfaces with the polseshaft 10 and trip latch of the circuit breaker 2 such that, when the poleshaft 10 rotates (e.g., without limitation, counterclockwise from the perspective of FIGS. 3-8) toward the open position (FIGS. 1, 3 and 4), the linking member 106 moves (e.g., without limitation, to the left from the perspective of FIGS. 3-8), which causes the second end 110 of the linking member 106 to engage and move the D-shaft 14, thereby pivoting the D-shaft 14 and unlatching the latch assembly 12 to trip open the circuit breaker 2. Accordingly, among other benefits, the secondary trip mechanism 100 functions to provide additional tripping force to ensure that the circuit breaker 2 does, in fact, trip as the contact carrier (not shown) of the circuit breaker 2 begins to open, and the poleshaft 10 rotates.

The interaction of the linking member 106 with the D-shaft 14 will now be described in greater detail. That is, the second end 110 of the linking member 106 includes a protrusion 118 having a first edge 120. The aforementioned shaft hub 112 includes a second edge 122 disposed at or about the recess 114 of the hub 112. It will, therefore, be appreciated that the linking member 106 is movable between a first position (FIGS. 6-8) corresponding to the first end 108 of the linking member 106 engaging and moving with the poleshaft 10 and the first edge 120 of the second end 110 engaging the second edge 122 of the hub 112 to move (e.g., without limitation, pivot clockwise from the perspective of FIGS. 3-8) the D-shaft 14, and a second position (FIGS. 3-5) corresponding to the protrusion 118 of the linking member 106 disengaging the hub 112. As will be described in greater detail hereinbelow, this motion of the linking member 106 is accomplished by a number of features (e.g., without limitation, barb 116; protrusion 118; cam surface 140; opening 160) of the linking member 106 in cooperation with various components (e.g., without limitation, poleshaft 10 and interlock pin 16 therefor; D-shaft hub 112; cam action pin 30; poleshaft tripper pivot 150) of the circuit breaker 2.

As best shown in FIG. 2, the example link assembly 104 further includes a biasing element, such as for example and without limitation, a spring 130. The spring 130 includes opposing first and second ends 132,134. The first end 132 of the spring 130 is coupled to the housing 4 of the circuit breaker 2 and, in particular, to a spring pin 18 which extends laterally outwardly from a side plate 22 of the circuit breaker housing 4. The second end 134 of the spring 130 is coupled to the linking member 106, as shown in FIGS. 3-8. Thus, the spring 130 is structured to bias the linking member 106 and, in particular, the barb 116 on the first end 108 of the linking member 106, toward engagement with the circuit breaker poleshaft 10.

In the example shown and described herein, the circuit breaker housing 4 includes a side plate assembly 20, which in addition to the aforementioned first side plate 22, further includes a second side plate 24 extending outwardly from the housing 4 opposite and distal from the first side plate 22, and cam action pin 30. The cam action pin 30 extends laterally outwardly from the first side plate 22 toward the linking member 106 and, in particular, a cam surface 140 thereof. The cam action pin 30 cooperates with the cam surface 140 to move (e.g., without limitation, upward and downward from the perspective of FIGS. 3-8) the second end 110 of the linking member 106 into and out of engagement with the D-shaft hub 112. More specifically, by way of example, in operation when the barb 116 of the linking member 106 is interlocked with the poleshaft interlock pin 16, as shown in FIGS. 6 and 7, movement of the poleshaft 10 correspondingly moves the linking member 106 such that the protrusion 118 of the second end 110 of the linking member 106 cooperates with D-shaft hub 112, as previously discussed hereinabove.

Figure 8:
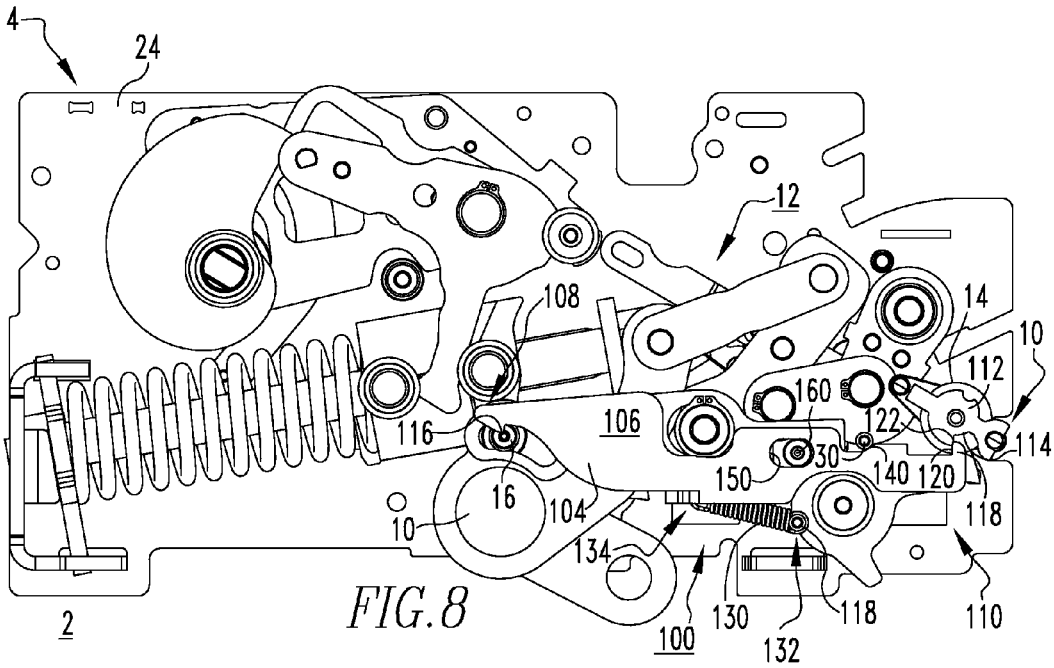
FIG. 8 is a side elevation view of the secondary trip mechanism of FIG. 7, shown in the orientation corresponding to the circuit breaker being disposed in the reset position.

Such movement of the linking member also results in the cam action pin 30 cooperating with the cam surface 140 of the linking member 106. Specifically, as the linking member 106 moves (e.g., to the left from the perspective of FIGS. 3-8), the cam action pin 30 engages the cam surface 140 which is inclined, causing the second end 110 of the linking member 106 to move (e.g., downward from the perspective of FIGS. 3-8), as shown in FIG. 8 to eventually disengage the D-shaft 14. This movement also results in the first end 108 of the linking member 106 disengaging the poleshaft 10 such that the circuit breaker 2 and D-shaft 14 return to the reset position (FIG. 8).

In the example shown and described herein, the operating mechanism 8 of the circuit breaker 2 further includes a poleshaft tripper pivot 150, which is movably disposed within an opening 160 of the linking member 106. The opening 150 is disposed between the first and second ends 108,110 of the linking member 106, as shown in FIGS. 3-8.

FIG. 3 shows the secondary trip mechanism 100 and, in particular, the components of the link assembly 104 therefor, disposed in their respective positions corresponding to the circuit breaker 2 being open and discharged. FIG. 4 shows the components of the link assembly 104 of the secondary trip mechanism 100 as positioned when the circuit breaker 2 is open and charged. FIG. 5 shows the circuit breaker 2 and secondary trip mechanism 100 as disposed when the circuit breaker 2 is in the toe touch position. FIG. 6 shows the poleshaft 10 of the circuit breaker 2 having begun to rotate backwards, wherein the barb 116 of first end 108 of the linking member 106 has engaged the interlock pin 16 of the poleshaft 10, as previously discussed hereinabove. FIG. 7 shows the components of the secondary trip mechanism 100 after further back rotation of the poleshaft 10, wherein the circuit breaker 2 has almost tripped. Finally, FIG. 8 shows the circuit breaker 2 after tripping, wherein the barb 116 of the first end 108 of the linking member 106 has disengaged the interlock pin 116 of the poleshaft 10, and the second end 110 of the linking member 106 is disengaging the D-shaft hub 112 to permit the circuit breaker 2 to be reset.

Accordingly, the disclosed secondary trip mechanism 100 provides a convenient and efficient mechanical link for interfacing with the circuit breaker poleshaft 10 to ensure sufficient additional tripping force is applied to effectuate tripping operation of the circuit breaker 2 in response to a trip condition.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A secondary trip mechanism for an electrical switching apparatus, said electrical switching apparatus including a housing, separable contacts enclosed by the housing, and an operating mechanism for opening and closing said separable contacts, said operating mechanism comprising a poleshaft, a latch assembly and a trip D-shaft structured to unlatch said latch assembly in response to a trip condition, said secondary trip mechanism comprising:

a trip D-shaft assembly structured to be disposed on said trip D-shaft; and a link assembly comprising a linking member, said linking member including a first end and second end disposed opposite and distal from the first end, the first end being structured to cooperate with said poleshaft, the second end cooperating with said trip D-shaft assembly, wherein, when said poleshaft moves in response to a trip condition, said linking member is structured to transmit movement of said poleshaft into movement of said trip D-shaft assembly, wherein said trip D-shaft assembly includes a hub having a recess; and wherein the second end of said linking member cooperates with said shaft hub at or about said recess, and wherein said poleshaft includes an interlock pin; wherein the first end of said linking member includes a barb; and wherein said barb is structured to interlock with said interlock pin; and wherein, when said barb interlocks with said interlock pin, said linking member is structured to move with said poleshaft.

2. The secondary trip mechanism of claim 1 wherein the second end of said linking member includes a protrusion; wherein said protrusion includes a first edge; wherein said hub includes a second edge disposed at or about said recess; and wherein said linking member is movable between a first position corresponding to the first end engaging and moving with said poleshaft and the first edge of the second end engaging the second edge of said hub to move said D-shaft, and a second position corresponding to said protrusion disengaging said hub.

3. The secondary trip mechanism of claim 1 wherein said link assembly further comprises a biasing element; wherein said biasing element includes a first end and a second end disposed opposite and distal from the first end of said biasing element; wherein the first end of said biasing element is structured to be coupled to the housing of said electrical switching apparatus; wherein the second end of said biasing element is coupled to said linking member; and wherein said biasing element is structured to bias said linking member into engagement with said poleshaft.

4. The secondary trip mechanism of claim 3 wherein said biasing element is a spring; wherein the housing of said electrical switching apparatus includes a spring pin; wherein the first end of said spring is structured to be coupled to said spring pin; and wherein the second end of said spring is coupled to said linking member.

5. The secondary trip mechanism of claim 4 wherein the housing of said electrical switching apparatus further includes a side plate assembly; wherein said side plate assembly comprises a side plate; and wherein said spring pin extends laterally outwardly from said side plate.

6. The secondary trip mechanism of claim 5 wherein said side plate assembly further comprises a cam action pin; and wherein said cam action pin extends laterally outwardly from said side plate toward said linking member.

7. The secondary trip mechanism of claim 6 wherein said linking member further comprises a cam surface; and wherein said cam action pin is structured to cooperate with said cam surface to move the second end of said linking member into and out of engagement with said D-shaft.

8. A secondary trip mechanism for an electrical switching apparatus, said electrical switching apparatus including a housing, separable contacts enclosed by the housing, and an operating mechanism for opening and closing said separable contacts, said operating mechanism comprising a poleshaft, a latch assembly and a trip D-shaft structured to unlatch said latch assembly in response to a trip condition, said secondary trip mechanism comprising:

a trip D-shaft assembly structured to be disposed on said trip D-shaft; and a link assembly comprising a linking member, said linking member including a first end and second end disposed opposite and distal from the first end, the first end being structured to cooperate with said poleshaft, the second end cooperating with said trip D-shaft assembly, wherein, when said poleshaft moves in response to a trip condition, said linking member is structured to transmit movement of said poleshaft into movement of said trip D-shaft assembly, and wherein said operating mechanism further comprises a poleshaft tripper pivot; wherein said linking member further includes an opening extending through said linking member between the first end of said linking member and the second end of said linking member; and wherein said poleshaft tripper pivot is structured to be movably disposed in said opening.

9. An electrical switching apparatus comprising:

a housing;

separable contacts enclosed by the housing;

an operating mechanism for opening and closing said separable contacts, said operating mechanism comprising a poleshaft, a latch assembly and a trip D-shaft, said trip D-shaft unlatching said latch assembly in response to a trip condition; and a secondary trip mechanism comprising:

a trip D-shaft assembly disposed on said trip D-shaft, and a link assembly comprising a linking member, said linking member including a first end and second end disposed opposite and distal from the first end, the first end cooperating with said poleshaft, the second end cooperating with said trip D-shaft assembly, wherein, when said poleshaft moves in response to a trip condition, said linking member transmits movement of said poleshaft into movement of said trip D-shaft assembly, wherein said trip 1)-shaft assembly includes a hub having a recess; and wherein the second end of said linking member cooperates with said shaft hub at or about said recess, and wherein said poleshaft includes an interlock pin; wherein the first end of said linking member includes a barb; and wherein said barb interlocks with said interlock pin; and wherein, when said barb interlocks with said interlock pin, said linking member moves with said poleshaft.

10. The electrical switching apparatus of claim 9 wherein the second end of said linking member includes a protrusion; wherein said protrusion includes a first edge; wherein said hub includes a second edge disposed at or about said recess; and wherein said linking member is movable between a first position corresponding to the first end engaging and moving with said poleshaft and the first edge of the second end engaging the second edge of said hub to move said D-shaft, and a second position corresponding to said protrusion disengaging said hub.

11. The electrical switching apparatus of claim 9 wherein said link assembly further comprises a biasing element; wherein said biasing element includes a first end and a second end disposed opposite and distal from the first end of said biasing element; wherein the first end of said biasing element is coupled to the housing; wherein the second end of said biasing element is coupled to said linking member; and wherein said biasing element biases said linking member into engagement with said poleshaft.

12. The electrical switching apparatus of claim 11 wherein said biasing element is a spring; wherein the housing of said electrical switching apparatus includes a spring pin; wherein the first end of said spring is coupled to said spring pin; and wherein the second end of said spring is coupled to said linking member.

13. The electrical switching apparatus of claim 12 wherein the housing further includes a side plate assembly; wherein said side plate assembly comprises a side plate; and wherein said spring pin extends laterally outwardly from said side plate.

14. The electrical switching apparatus of claim 13 wherein said side plate assembly further comprises a cam action pin; wherein said cam action pin extends laterally outwardly from said side plate toward said linking member, wherein said linking member further comprises a cam surface; and wherein said cam action pin cooperates with said cam surface to move the second end of said linking member into and out of engagement with said D-shaft.

15. An electrical switching apparatus comprising:

a housing, separable contacts enclosed by the housing;

an operating mechanism for opening and closing said separable contacts, said operating mechanism comprising a poleshaft, a latch assembly and a trip D-shaft, said trip D-shaft-unlatching said latch assembly in response to a trip condition; and a secondary trip mechanism comprising:

a trip D-shaft assembly disposed on said trip D-shaft, and a link assembly comprising a linking member, said linking member including a first end and second end disposed opposite and distal from the first end, the first end cooperating with said poleshaft, the second end cooperating with said trip D-shaft assembly, wherein, when said poleshaft moves in response to a trip condition, said linking member transmits movement of said poleshaft into movement of said trip D-shaft assembly, and wherein said operating mechanism further comprises a poleshaft tripper pivot; wherein said linking member further includes an opening extending through said linking member between the first end of said linking member and the second end of said linking member, and wherein said poleshaft tripper pivot is movably disposed in said opening.

16. The electrical switching apparatus of claim 15 wherein said electrical switching apparatus is a circuit breaker; where said circuit breaker includes a first side plate extending outwardly from the housing and a second side plate extending outwardly from the housing opposite and distal from the first side plate; and wherein said secondary trip mechanism is substantially disposed between said first side plate and said second side plate.

* * * * *